United States Patent [19]

Ehret

[11] Patent Number: 4,543,623

[45] Date of Patent: Sep. 24, 1985

[54] NON-STAINING UNDERWATER LIGHT ASSEMBLY FOR POOLS

[75] Inventor: Gordon F. Ehret, Alhambra, Calif.

[73] Assignee: Sta-Rite Industries, Inc., Milwaukee, Wis.

[21] Appl. No.: 614,953

[22] Filed: May 29, 1984

[51] Int. Cl.[4] ..... F21V 29/00

[52] U.S. Cl. ..... 362/267; 362/306; 362/310; 362/390

[58] Field of Search ..... 362/267, 306, 310, 390

[56] References Cited

U.S. PATENT DOCUMENTS

| | | | |
|---|---|---|---|
| 3,046,388 | 7/1962 | Shinn | 362/267 |
| 3,098,167 | 7/1963 | Jensen et al. | 362/267 X |
| 3,952,190 | 4/1976 | Perkins | 362/4 |
| 4,059,753 | 11/1977 | Tart et al. | 362/267 |
| 4,112,485 | 9/1978 | Sutter | 362/390 X |
| 4,190,976 | 3/1980 | Hurt | 362/267 X |
| 4,293,847 | 10/1981 | McCarty | 362/267 X |
| 4,450,511 | 5/1984 | Micha | 362/373 X |

*Primary Examiner*—Peter A. Nelson
*Attorney, Agent, or Firm*—Larry L. Shupe

[57] ABSTRACT

A light fixture for underwater use in swimming pools has a waterproof gasket between the lens and the housing enclosing the electrical components. The gasket is fabricated of an off-white, neoprene material and is devoid of any coloring agents, such as carbon black, which are subject to leaching by chlorine-containing water in the pool. As a result, discoloration of the wall of the pool and also of the lens will not occur, even where chlorine concentrations are relatively high.

8 Claims, 6 Drawing Figures

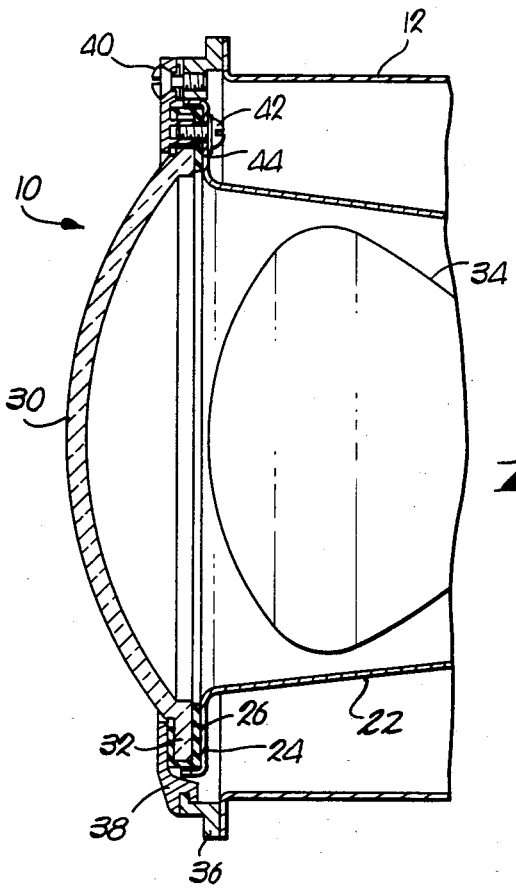
Fig.2.
Fig.1.
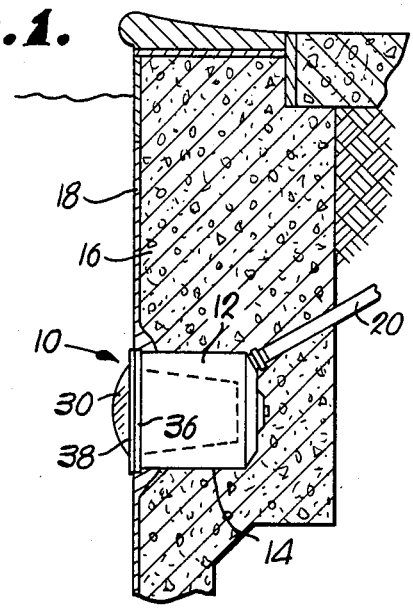
Fig.5.
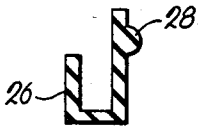
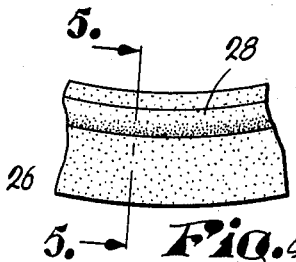
Fig.4.
Fig.3.
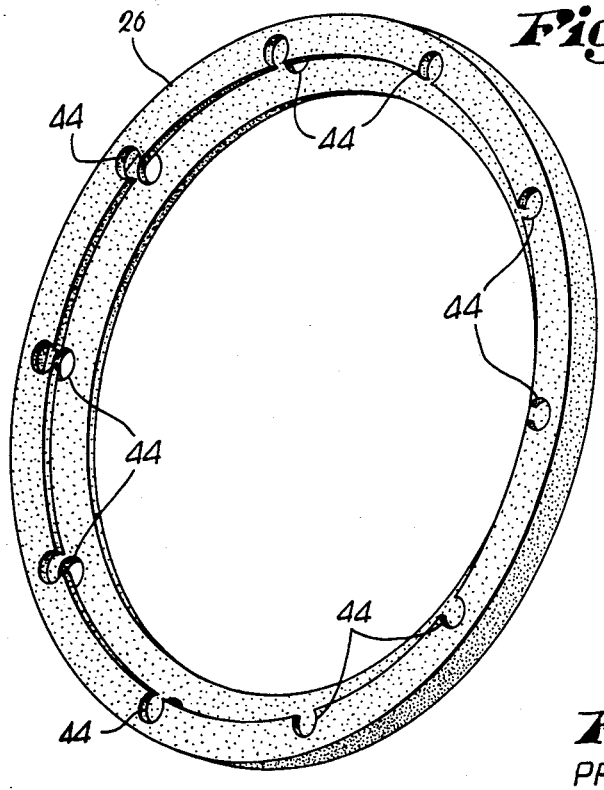
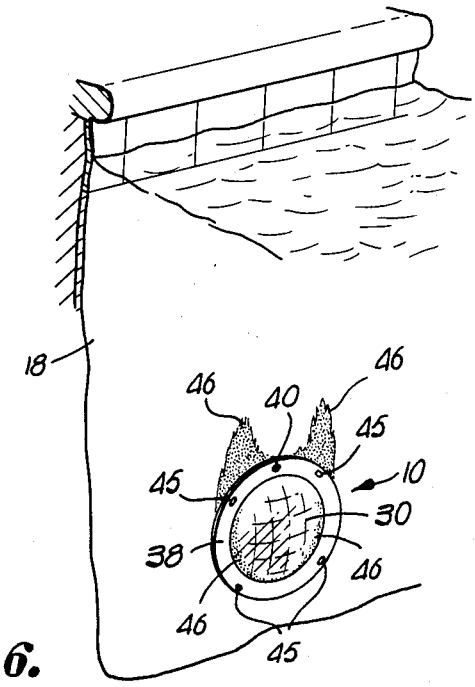
Fig.6.
PRIOR ART

NON-STAINING UNDERWATER LIGHT ASSEMBLY FOR POOLS

BACKGROUND OF THE INVENTION

1. Field of the Invention

My present invention relates to improvements in lens gaskets for underwater lights.

2. Description of the Prior Art

Underwater lighting has long been used to provide illumination in swimming pools, spas, fountains and similar water-containing structures during non-daylight periods. While smaller pools may require only one light, larger public pools are usually provided with a plurality of fixtures. These lights are contained in a housing disposed in a recess on a side of the pool wall below the normal water level, typically at depths ranging from 18 inches to 48 inches.

Over the years an unsightly black discoloration has been observed on the pool wall immediately adjacent the underwater light, causing many problems for the owner. To clean this stain, the pool must be drained below the surface of the light, and the latter disconnected and removed. The discoloration must be cleaned by scrubbing with an acid wash solution and the residue remaining on the wall then rinsed with a water solution. If the stain cannot be removed by an acid wash then the wall must be replastered. This cleaning procedure is a nuisance for both the pool owner and his guests. The method is time consuming and also prohibits use of the pool during this period. The handling and storage of the acid wash solution creates a risk of injury. Additionally, the owner then faces the time and expense of refilling the pool, restoring the chlorine level, and returning the water to its proper hydrogen-ion concentration. Even after a thorough cleaning attempt, the discoloration is often still visible and unsightly. Over a period of time, the strain will darken and become more pronounced. The pool owner must then repeat the elaborate and expensive procedure outlined above. The owner also faces the prospect of repeating this endless cycle many times over the lifetime of the pool.

The stain may also extend over the glass lens of the lighting fixture and require additional, frequent cleaning. If the discoloration is allowed to accumulate and intensify, the illuminating ability of the fixture will be drastically reduced, thereby creating a risk of accident during non-daylight periods. This stain is difficult to remove from the uneven, bumpy outer surfaces common to many lenses, and the use of harsh, abrasive cleansers, which may etch the glass, is prohibited.

Because the discoloration occurs in an area immediately adjacent the light fixture, it has generally been assumed that the chemical reaction of the chlorine and acids in the pool water were attacking the chrome on the face ring and other metal parts of the assembly. However, efforts to change the composition of the ring and other metal parts have not eliminated this stain.

SUMMARY OF THE INVENTION

My present invention eliminates the discoloration associated with underwater light fixtures. I have discovered that the stain is caused by the black neoprene gasket normally used with a light fixture and not from the chrome and metal parts of the light.

More specifically, I have found that an off-white neoprene lens gasket will prevent darkening of the glass lens and of the pool wall adjacent the light. The chlorine used in swimming pools to maintain sanitation will attack a black neoprene gasket and physically leach carbon black from the latter. This black residue is deposited on both the pool walls and the lens surface. By replacing the black gasket with a non-staining, off-white neoprene gasket, no discoloration has been observed even when excessive chemical treatment and concentrated chlorine solutions are present in the water. As long as there are no coloring agents in the material which may be subject to leaching, the gasket will no longer be the cause of these stains.

My invention will eliminate the substantial amount of time normally necessary to clean pools. Scrubbing with a hazardous acid wash will not be necessary. The pool need not be drained and refilled with water and the necessary amount of chemicals. Replastering the wall will not be necessary. The pool is not subject to lengthy periods of unusability. Also, elimination of the black deposits on the face of the lens will allow the lamp to more efficiently illuminate the pool during non-daylight hours, thereby reducing risk of accident to both pool users and passersby.

IN THE DRAWING

FIG. 1 is a side elevational view of an underwater light fixture disposed on a pool wall;

FIG. 2 is a side cross-sectional view of the lighting assembly;

FIG. 3 is a perspective view of the gasket;

FIG. 4 is an enlarged, fragmentary view of one end of the gasket;

FIG. 5 is a transverse cross-sectional view taken along line 5—5 of FIG. 4; and FIG. 6 is perspective view of the light assembly in a pool wall showing the effect of the prior art.

DESCRIPTION OF THE PREFERRED EMBODIMENT

A light assembly 10, as shown in FIG. 1, includes a generally cylindrical outer niche 12 disposed in a recess 14 of a concrete pool wall 16. A plastered surface 18 is disposed on an inner surface of the wall 16 to present a finished appearance. A conduit 20 extends rearwardly and upwardly from the niche 12.

Referring to FIG. 2, a frustum-shaped housing 22, having a turned, peripheral edge 24, is disposed in concentric relation to the niche 12. A ring-shaped gasket 26, fabricated of substantially white neoprene, is disposed on the edge 24 in concentric relation and is generally transversely U-shaped, presenting an opening toward the axis of the housing 22. The gasket 26 also has an integral, peripheral ridge 28 (as shown in FIG. 5), disposed to engage the edge 24. A translucent, generally concavo-convex lens 30 has a flat outer peripheral flange 32 partially disposed within the gasket 26. An electric bulb 34, concentric with the housing 22, is in direct communication with the lens 30 for illumination of an underwater area near the assembly 10.

A ring-shaped metal band 36 is disposed concentrically on an outer edge of the niche 12. A face ring 38 is concentric to the band 36 and attached to the latter by an oval head screw 40. Ten machine screws 42 clamp the gasket 26 between the edge 24, the flange 32, and the ring 38, each threading through a hole 44 in the gasket 26. Four peripheral, spaced slots 45 are disposed on the ring 38 to allow water circulation between the main body of the pool and the chamber bounded by the niche 12 and the housing 22.

During assembly, the gasket 26 is placed around the outer peripheral edge of the flange 32. The housing 22 and the ring 38 are concentrically placed over the gasket 26, and the machine screws 42 are then threaded through the holes 44 and into ring 38. After the machine screws 42 are tightened securely, the housing 22 is inserted within the niche 12 and the oval head screw 40 is tightened to clamp the ring 38 to the band 36.

FIG. 6 illustrates the effect of prior art gaskets heretofore used in swimming pools. The discoloration 46, caused by the leaching of carbon black and other coloring agents, has occurred both on the plastered surface 18 and the lens 30. As shown, the discoloration 46 tends to migrate in an upwardly fashion, causing deep staining on the surface 18 and also a deposition on the lens 30, correspondingly reducing the illuminating ability of the light assembly 10.

In use, chlorine-compound-bearing water contacts the exposed portion of the gasket 26 in the area between ring 38 and the flange 32. However, the gasket 26, being devoid of coloring agents, can not exude the latter to the water. Consequently, as the water migrates away from the gasket 26, the water is unable to darken either the lens 30 or the surface 18.

I claim:

1. In an underwater lighting assembly having a housing adapted to be mounted in the wall of the structure for confining a body of water containing a significant quantity of a chlorine compound, said housing being provided with an opening for light rays to illuminate the area of the water surrounding the assembly and a translucent lens removably mounted on the housing in closing relationship to said opening, the combination with said housing and lens of:

a gasket configured to close the space between the housing and the lens and provide a water tight seal therebetween, said gasket being positioned such that it is in contact with the water confined by said structure when in its operative water sealing disposition, the gasket being fabricated of a synthetic elastomeric material which is resistant to deterioration over long periods of exposure to water containing a chlorine compound, said material being devoid of a coloring agent such as carbon black which is subject to leaching from the gasket when exposed over a time period to a chlorine compound bearing quantity of water.

2. The invention of claim 1, wherein said material consists of a synthetic rubber made by the polymerization of chloroprene.

3. The invention of claim 2, said rubber being neoprene.

4. The invention of claim 3, said neoprene being substantially white.

5. In an underwater lighting assembly having a housing adapted to be mounted in the wall of the structure for confining a body of water containing a significant quantity of a chlorine compound, said housing being provided with an opening for light rays to illuminate the area of the water surrounding the assembly and a translucent lens removably mounted on the housing in closing relationship to said opening, the combination with said housing and lens of:

a gasket configured to close the space between the housing and the lens and provide a water tight seal therebetween, said gasket including a plurality of lips defining a generally J-shape cross section, said gasket being positioned such that it is in contact with the water confined by said structure when in its operative water sealing disposition, the gasket being fabricated of a synthetic elastomeric material which is resistant to deterioration over long periods of exposure to water containing a chlorine compound, and having a plurality of apertures formed therethrough for receiving clamping bolts, said material being devoid of a coloring agent such as carbon black which is subject to leaching from the gasket when exposed over a time period to a chlorine compound bearing quantity of water.

6. The invention set forth in claim 5 wherein said material comprises a synthetic rubber made by the polymerization of chloroprene.

7. The invention set forth in claim 6 wherein said housing includes a face ring having openings therethrough for permitting water circulation between a body of water and the interior of said housing and said synthetic rubber is neoprene.

8. The invention set forth in claim 7 wherein said neoprene is substantially white in color.

* * * * *